US008684022B1

(12) United States Patent
McFarland

(10) Patent No.: US 8,684,022 B1
(45) Date of Patent: Apr. 1, 2014

(54) CONDENSATE DRAIN CLEARING DEVICE AND METHOD

(71) Applicant: Richard Dean McFarland, Cincinnati, OH (US)

(72) Inventor: Richard Dean McFarland, Cincinnati, OH (US)

(73) Assignee: Good Day Tools, LLC, Cincinnati, OH (US)

( * ) Notice: Subject to any disclaimer, the term of this patent is extended or adjusted under 35 U.S.C. 154(b) by 0 days.

(21) Appl. No.: 13/752,579

(22) Filed: Jan. 29, 2013

(51) Int. Cl.
*B08B 1/00* (2006.01)

(52) U.S. Cl.
USPC ... 137/15.07; 4/255.03; 4/255.12; 15/104.16; 15/345

(58) Field of Classification Search
USPC ..... 137/15.07; 4/255.01, 255.02, 255.03, 4/255.11, 255.12; 15/104.03, 104.05, 15/104.16, 316.1, 345
See application file for complete search history.

(56) References Cited

U.S. PATENT DOCUMENTS

| | | | | |
|---|---|---|---|---|
| 2,608,695 | A * | 9/1952 | Skibowski | 4/255.02 |
| 5,003,657 | A * | 4/1991 | Boiteau et al. | 15/104.33 |
| 6,427,458 | B1 * | 8/2002 | Fowler | 62/150 |
| 6,779,202 | B1 * | 8/2004 | Alldredge | 4/255.02 |
| 7,752,684 | B1 * | 7/2010 | Pieretti | 4/255.11 |

* cited by examiner

*Primary Examiner* — John Rivell
*Assistant Examiner* — Reinaldo Sanchez-Medina
(74) *Attorney, Agent, or Firm* — Hasse & Nesbitt LLC; Ronald J. Richter; Daniel F. Nesbitt

(57) ABSTRACT

A device to clear a blockage from an HVACR condensate drain line. A piston connected to a rod with a handle is inserted directly into the distal or outlet end of a condensate drain pipe and then rapidly withdrawn to create a vacuum or suction within the drain line. When sufficient suction pressure is created, it will dislodge a blockage in the drain line. Typically the piston has a proximal end with a diameter slightly greater than the inside diameter of the condensate drain pipe. Upon removal of the device from the drain pipe, the proximal end is caused to expand to its full diameter, creating an airtight and fluid tight seal with the inner diameter of the drain pipe, allowing for the creation of negative pressure and/or suction upstream to dislodge the blockage.

7 Claims, 3 Drawing Sheets

CONDENSATE DRAIN CLEARING DEVICE AND METHOD

FIELD OF THE INVENTION

This invention relates to a device and method for clearing a heating, ventilation, air conditioning and/or refrigeration (HVACR) condensate drain line. In particular, the invention relates to a device which is inserted directly into an HVACR condensate drain line and then removed, the removal creating a suction pressure sufficient to clear blockages within the drain line.

BACKGROUND OF THE INVENTION

Heating, ventilation, air conditioning and/or refrigeration (HVACR) systems typically have evaporator coils that are used in the cooling of air to be distributed by the system through the building or area to be cooled. These evaporator coils collect water formed by humid air which is condensed after contacting the cold metal on the evaporator coils. Water then drips from the coils into a drain pan usually placed beneath the air conditioning system. The drain pan typically has an outlet connected to a pipe, which directs it to a drain, sewer system, or an outside area where water can drip without damaging the building.

The drain line from the drain pan frequently clogs or plugs with "sludge" due to algae or fungus growing in the lines. When this happens, the water backs up into the drain line, fills the drain pan and overflows into the air supply duct. The water then spills out through any seam or hole available, and the overflowing water may cause considerable property damage, either from physical water damage or an electrical short. Therefore, the clogging of condensate drain lines is a considerable problem and can cause great concern to the homeowner, and typically an emergency call to the local heating and air conditioning service.

The experienced serviceman will recognize any condensate drain line plugging problem. The sludge is not a hardened mass difficult to remove. Rather, in the past such plugs have been readily removed by the serviceman connecting a high pressure source to the end of the drain line and blowing a short blast of gas up into the line. While this often dislodges the plug, it is typically ejected towards the inside A/C unit or drain pan, which can be messy and cause further damage to the unit or surrounding area.

Blockages also occur in other types of fluid-carrying lines, such as plumbing or toilet lines. Consequently, a variety of inventions are known in the art from such things as a plunger, sometimes called a plumber's helper, or a plumber's snake. Typically, these devices operate either by applying a mechanical or a hydraulic force to a blockage. However, condensate drain lines in HVACR systems are relatively small in diameter and are typically made of a more delicate material than water or sewage-carrying lines. Further, condensate drain lines may traverse relatively large distances from the inside air handler or evaporator coil where the condensation collects to the outside point where the condensation drains by means of the drain line. Consequently, things like plumber snakes or plungers are not helpful to clear blocked HVACR condensate drain lines.

Currently, an HVACR service technician has several options when confronted with a blocked drain line. He can clean out the drain pan and then apply air pressure within the drain pan end, or proximal end, of the drain line in hopes of clearing the blockage. However, this involves getting into a typically very small crawl space or attic in order to reach the drain pan area of the unit. The technician can also cut the drain line somewhere along its length in order to apply pressure or suction, which can lead to spillage from the drain line and require repair or partial replacement of the drain line after it is cut. For example, U.S. Pat. No. 5,666,690 to Domansky proposes inserting a $CO_2$ powered cylinder into a cut drain line to clear blockages.

The technician can also apply pressure or suction at the drain end, or distal end, of the drain line. In the past, service technicians have been known to use their mouth to do this, with potentially unpleasant and/or unhealthy consequences. Also, a variety of different types of pumps that induce either a pressure or suction at the drain end of the drain line have been proposed for cleaning of drain lines. For example, U.S. Pat. No. 6,427,458 to Fowler discloses a pump having a cylinder that connects to the outside end of the drain line to create either a suction/vacuum or a positive pressure within the pump, which is communicated to the drain line for removing a blockage. U.S. Pat. No. 3,934,280 to Tancredi discloses a drain clearing device having a cylindrical body and a retractable piston plunger within. A flared flange is attached near the lower end of the cylindrical body to facilitate seating of the device onto a drain exit. Despite this work there is still a need for a simple and effective device to unblock or unclog a condensate drain line for HVACR systems.

SUMMARY OF THE INVENTION

In light of the foregoing, the present invention provides a device for unclogging condensate drain lines of residential and commercial HVACR systems in a very simple and efficient manner. The device is very economical to produce and very easy to use.

A first aspect of the invention provides a device for clearing a clog in a condensate drain line, the device consisting of: (a) a piston for insertion into and subsequent withdrawal from the outlet end of a condensate drain pipe, the piston comprising a proximal flange for creating a seal with the drain pipe upon withdrawal; (b) a rod, wherein the piston is attached to a first end of the rod; and (c) a handle attached to a second end of the rod opposite the piston.

A second aspect of the invention provides a device for clearing a clog in a condensate drain line, the device comprising: (a) a piston for insertion into and subsequent withdrawal from the outlet end of a condensate drain pipe, wherein the proximal end of the piston is flexible and has a diameter that is slightly greater than the inside diameter of the condensate drain pipe; (b) a rod, wherein the piston is attached to a first end of the rod; and (c) a handle attached to a second end of the rod opposite the piston.

A third aspect of the invention provides a method for clearing a clog in a condensate drain line, comprising the steps of: (a) inserting a piston of a device for clearing a clog directly into the outlet end of a condensate drain pipe; and (b) withdrawing the piston from the drain pipe with a rapid and forceful motion to create a suction pressure within the drain line adequate to dislodge a blockage within the drain line, thereby allowing water to freely drain through the drain pipe into the outside area.

The nature and advantages of the present invention will be more fully appreciated from the following drawings, detailed description and claims.

BRIEF DESCRIPTION OF THE DRAWINGS

A more complete appreciation of the present invention and many of the principles and attendant advantages thereof will be readily understood by reference to the following detailed description when taken in conjunction with the accompanying drawings, in which.

DETAILED DESCRIPTION OF THE INVENTION

Figure 1:
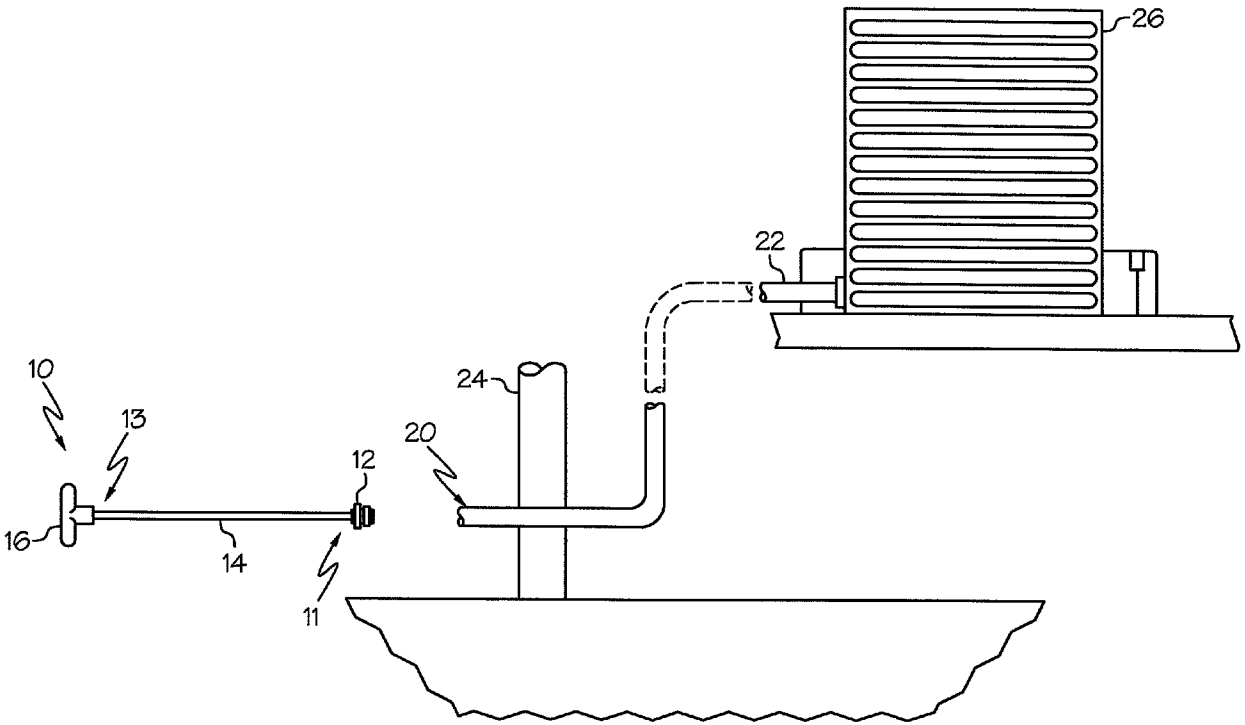
FIG. 1 is a front perspective view of one embodiment of the present invention prior to insertion into a drain pipe of an HVACR system.

The present invention is a device for unplugging condensate drain lines of residential and commercial HVACR systems. As illustrated in FIG. 1, one embodiment of the device 10 of the invention consists of a piston 12 for insertion into and withdrawal from the outlet end 20 of a condensate drain pipe 22. A rod 14 is attached to the piston 12 at a first end 11; and a handle 16 is attached to a second end 13 of the rod, opposite the piston. The piston 12 can be easily inserted directly into/inside the distal or outlet end 20 of the condensate drain pipe 22, which typically exits from a wall 24 of a building or home at an outdoor location that is relatively easy to access. As shown, the drain pipe 22 is connected to an HVACR system 26, typically located inside a house or building.

To use the device, a technician will go to the outlet end 20 of the drain pipe 22, insert the piston 12 of the device 10 into the drain pipe, and then rapidly and forcefully pull backwards on the handle 16. Slow backward movement of the device may allow the pressures on either side of the piston to equilibrate, so the movement should be relatively rapid and forceful, taking less than a second to remove the device from the drain line. The piston 12, upon being rapidly and forcefully pulled backwards, creates an air- and fluid-tight seal with the inner diameter of the drain pipe, and a suction pressure results from the backward movement of the piston within the drain pipe that is capable of removing or dislodging a clog upstream.

Figure 2A:
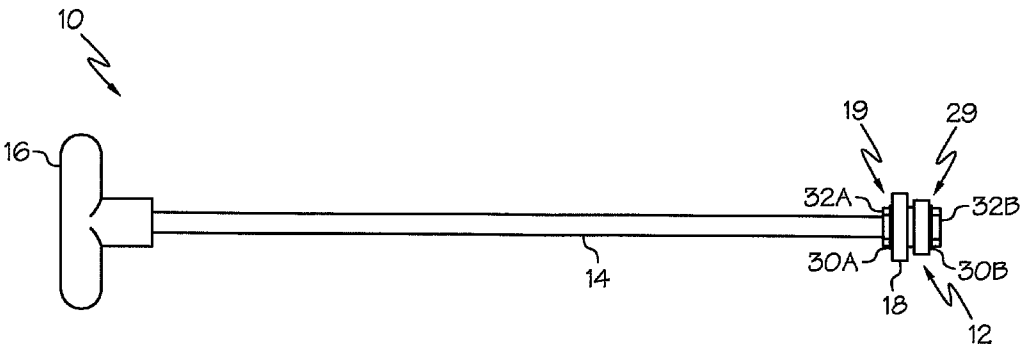
FIG. 2A is a close-up view of one embodiment of the invention.
Figure 2B:
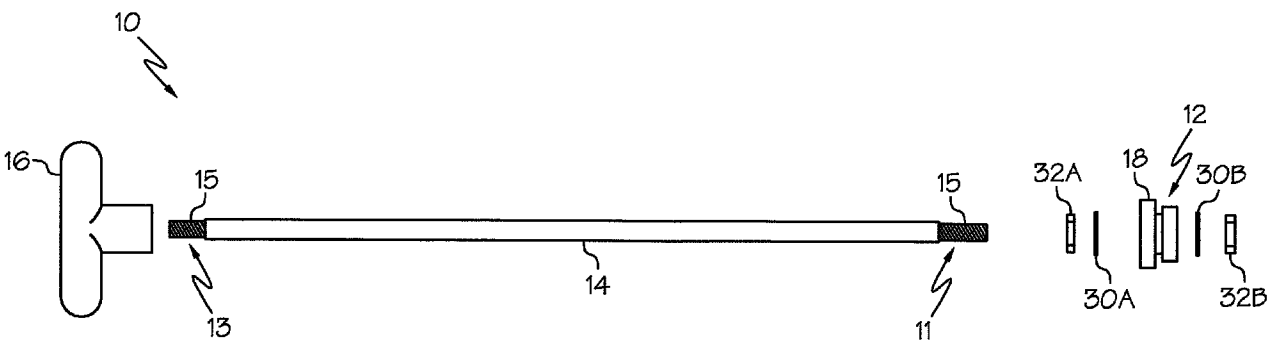
FIG. 2B is an exploded view of the device of FIG. 2A.

As shown in FIGS. 2A and 2B, the piston 12 of the device 10 can include a flexible flange 18 at its proximal end 19. The diameter of the piston generally decreases from proximal to distal ends, the proximal or flange end 19 of the piston having a diameter that is slightly greater than the inside diameter of a condensate drain pipe, which is typically about three-fourths of an inch (i.e. ¾ inch) in diameter. The distal or leading end 29 of the piston has a diameter that is slightly less than the inside diameter of the condensate drain pipe. The rod 14 is typically has threads 15 at both ends 11, 13 thereof (see FIG. 2B), and the piston 12 is screwed onto the first end 11 with the use of a pair of flat washers 30A, 30B and retaining nuts 32A, 32B secured on either side of the piston 12, while the handle 16 is screwed onto the second end 13, opposite the piston 12. The handle 16 can be shaped to fit a human hand, with gripping portions that more easily allow the user to pull in a direction away from the piston end.

The retaining nuts 32A and 32B, and particularly the distal retaining nut 32B, when tightened, can axially compress the piston 12. The piston 12, which is typically made of a flexible material such as rubber, upon axial compression will have a slightly larger diameter. Conversely, the diameter of the piston can be made slightly smaller by loosening at least the distal retaining nut 32B. This allows the piston to fit into drain pipes that may be slightly less or more than the standard three-quarter inch diameter. Also, should a larger or smaller diameter drain pipe be encountered that the device will not fit into, even after adjustment by tightening or loosening the distal retaining nut 32B, then replacement pistons can be made available to fit such pipes that are larger or small than the standard ¾ inch diameter pipes. In this case, the technician can unscrew the distal retaining nut 32B and remove the washer 30B as well as the current piston 12, and replace the piston with one in which the proximal portion 19 of the piston 12 has a diameter matching the diameter of the drain pipe presented to him.

Figure 3A:
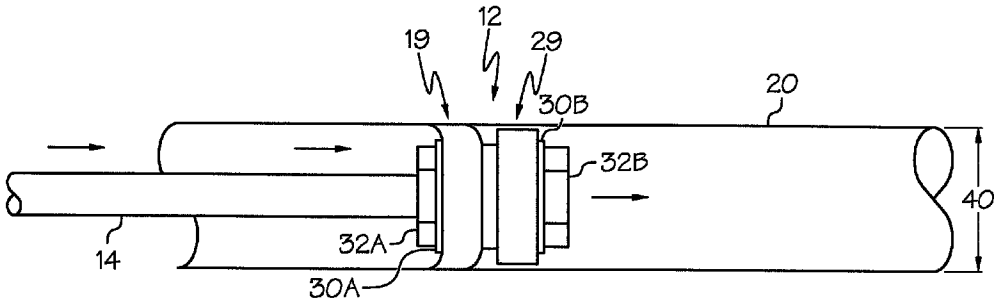
FIG. 3A is a perspective view of the one embodiment of the invention being inserted into a drain pipe.
Figure 3B:
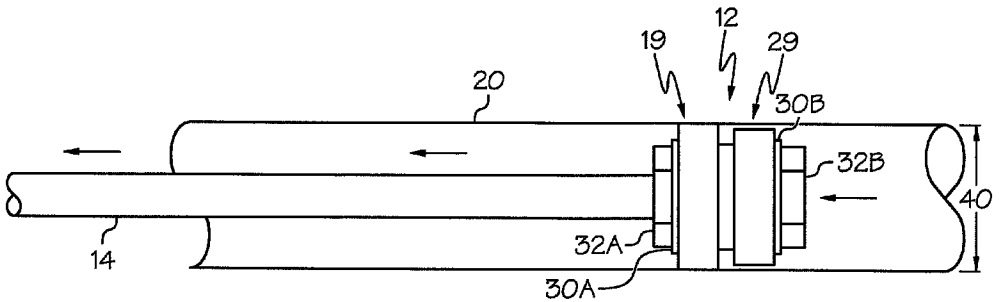
FIG. 3B is a perspective view of the device of FIG. 3A being withdrawn from the drain pipe.

In use, the technician initially inserts the piston 12 of the device directly into the inner diameter of the outlet or distal end of a condensate drain pipe 20. Typically little resistance is met upon insertion of the piston into the drain pipe, because of the smaller diameter of the piston at its distal, leading end 29, and the ability of the proximal end 19 to bend backwards (see FIG. 3A), which allows air or fluid to pass and the pressures to equilibrate on either side of the piston within the pipe. As shown in FIG. 3B, upon rapid removal of the piston 12 via forcefully and rapidly pulling the device straight backwards (see arrows), the proximal end 19 is caused to expand to its full diameter, creating an air- and fluid-tight seal with the inner diameter 40 of the drain pipe 20, allowing for the creation of negative pressure and/or suction upstream. Typically the device should be pulled out of the drain line within less than a second, so that there is no equilibration of pressures on either side of the piston during withdrawal; therefore the technician pulls backwards rapidly and with force. Comparatively more resistance is typically met upon removal of the piston from the drain pipe than during insertion, because of the seal created by the piston, and the larger diameter of the piston at its proximal, flanged end 19. Also, during withdrawal in FIG. 3B, it can be appreciated that the distal portion of the piston 29 can block or prevent the proximal portion 19 from bending back (as the proximal portion 19 is able to do upon insertion, see FIG. 3A). Thus, a seal is created upon withdrawal of the piston, and any blockage upstream in the drain line encounters a strong negative pressure that can remove and/or dislodge it. The blockage is then sucked out of the outlet end of the drain line, and does not affect the A/C unit at the proximal end of the line. Nevertheless, the insertion and removal of the device into and out of the drain pipe is relatively easy to perform by a technician, and requires minimal training and no special skill set.

The device used for performing the method of the invention is different from prior art devices because the piston is directly inserted and withdrawn from the condensate drain pipe. Unlike a prior art pump, it is not part of a cylinder body wherein the cylinder connects to the end of the drain pipe via an insert or the like. After insertion, which typically includes inserting the device directly into the drain pipe until only the handle remains outside (or as far as the device can be inserted), the technician then rapidly withdraws the device by pulling the handle backwards and removing the piston from the drain pipe. The proximal end of the piston, upon rapid withdrawal from the drain pipe, creates an air- and fluid-tight seal with the inner diameter of the drain pipe, and the suction pressure that results from the backward movement of the piston within the drain line is typically powerful enough to dislodge and/or remove a blockage within the drain line, thereby allowing water to freely drain through the drain pipe into the outside area.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. A device for clearing a clog in a condensate drain line, the device consisting of:

a) a piston for insertion into and subsequent withdrawal from the outlet end of a condensate drain pipe, the piston comprising a proximal flange for creating a seal with the drain pipe upon withdrawal, the piston being secured to the rod by at least one retaining nut, wherein the piston can be compressed axially so that the diameter of the piston is slightly enlarged by tightening the retaining nut, and wherein the piston can be decompressed axially so that the diameter of the piston is made slightly smaller by loosening the retaining nut;

b) a rod, wherein the piston is attached to a first end of the rod; and c) a handle attached to a second end of the rod opposite the piston.

2. The device of claim 1, the piston having a proximal and a distal end, wherein the proximal end of the piston is flexible and has a diameter that is slightly greater than the inside diameter of the condensate drain pipe, and the distal end of the piston has a diameter that is slightly less than the inside diameter of the condensate drain pipe.

3. The device of claim 2, wherein the proximal end of the piston is in the form of a flexible flange for allowing the piston to be easily inserted into the drain line, while creating an air- and fluid-tight seal with the drain line upon withdrawal of the piston.

4. A device for clearing a clog in a condensate drain line, the device comprising:

a) a piston for insertion into and subsequent withdrawal from the outlet end of a condensate drain pipe, wherein the proximal end of the piston is flexible and has a diameter that is slightly greater than the inside diameter of the condensate drain pipe, the piston being secured to the rod by at least one retaining nut, wherein the piston can be compressed axially so that the diameter of the piston is slightly enlarged by tightening the retaining nut, and wherein the piston can be decompressed axially so that the diameter of the piston is made slightly smaller by loosening the retaining nut;

b) a rod, wherein the piston is attached to a first end of the rod; and c) a handle attached to a second end of the rod opposite the piston.

5. The device of claim 4, wherein the proximal end of the piston is in the form of a flange for allowing the piston to be easily inserted into the drain line, while creating an air- and fluid-tight seal with the drain line upon withdrawal of the piston.

6. A method for clearing a clog in a condensate drain line, comprising the steps of:

a) inserting a piston of a device for clearing a clog directly into the outlet end of a condensate drain pipe; and b) withdrawing the piston from the drain pipe with a rapid and forceful motion to create a suction pressure within the drain line adequate to dislodge a blockage within the drain line and allow water to freely drain through the drain pipe into the outside area.

7. The method of claim 6, wherein the device for clearing a clog includes a piston for insertion into and subsequent withdrawal from the outlet end of a condensate drain pipe, wherein the proximal end of the piston is flexible and has a diameter that is slightly greater than the inside diameter of the condensate drain pipe, and the distal end of the piston has a diameter that is slightly less than the inside diameter of the condensate drain pipe.

* * * * *